US007493778B2

(12) United States Patent
Engdahl

(10) Patent No.: US 7,493,778 B2
(45) Date of Patent: Feb. 24, 2009

(54) BOIL-OFF GAS CONDENSING ASSEMBLY FOR USE WITH LIQUID STORAGE TANKS

(75) Inventor: Gerald E. Engdahl, Wheaton, IL (US)

(73) Assignee: Chicago Bridge & Iron Company

( * ) Notice: Subject to any disclaimer, the term of this patent is extended or adjusted under 35 U.S.C. 154(b) by 295 days.

(21) Appl. No.: 11/502,947

(22) Filed: Aug. 11, 2006

(65) Prior Publication Data

US 2008/0034769 A1 Feb. 14, 2008

(51) Int. Cl.
*F25J 1/00* (2006.01)
*F17C 3/10* (2006.01)

(52) U.S. Cl. ..... 62/614; 62/48.2

(58) Field of Classification Search ..... 62/47.1, 62/48.1, 48.2, 614
See application file for complete search history.

(56) References Cited

U.S. PATENT DOCUMENTS 2,944,405 A * 7/1960 Basore et al. ..... 62/48.2
3,857,245 A * 12/1974 Jones ..... 60/651
4,276,749 A * 7/1981 Crowley ..... 62/48.2
5,537,824 A * 7/1996 Gustafson et al. ..... 62/7
6,470,706 B1 * 10/2002 Engdahl ..... 62/614
6,745,576 B1 * 6/2004 Granger ..... 62/48.2
2001/0042377 A1 * 11/2001 Pozivil ..... 62/48.3
2005/0126220 A1 * 6/2005 Ward ..... 62/625
2006/0032239 A1 * 2/2006 Sudduth et al. ..... 62/48.2
2006/0042312 A1 * 3/2006 Winningham ..... 62/620

* cited by examiner

*Primary Examiner*—William C Doerrler
(74) *Attorney, Agent, or Firm*—Marshall, Gerstein & Borun LLP

(57) ABSTRACT

The assembly includes a boil-off gas line that carries storage tank boil-off gas to a condenser that uses condensing liquid from the liquid send-out line to condense the gas. A level control valve on the condensing liquid line actively controls the flow of condensing liquid based on the liquid level in the condenser. A check valve prevents liquid from the send-out line from flowing into the condenser through the condensate line that discharges condensate from the condenser to the send-out line.

21 Claims, 5 Drawing Sheets

BOIL-OFF GAS CONDENSING ASSEMBLY FOR USE WITH LIQUID STORAGE TANKS

CROSS-REFERENCE TO RELATED APPLICATIONS

Not applicable.

BACKGROUND OF THE INVENTION

This invention relates generally to liquefied natural gas (LNG) systems. More specifically, it relates to arrangements for condensing boil-off gas from an LNG storage tank and condensing the gas into a send-out stream.

LNG is stored in storage tanks throughout the world. It is typically stored in liquid form at low pressure and cold temperatures, and is pumped to a high pressure before being vaporized and sent out through a natural gas pipeline or distribution system. The pumping operation typically involves a set of low-stage pumps (usually located in the storage tank) that pump the liquid to an inter-stage pressure and a set of high-stage booster pumps (located outside the storage tank).

Boil-off gas (BOG) is the result of heat input into a storage tank that causes some of the stored liquid to vaporize. It can also include vapor displaced by liquid when the tank is filled. Boil-off gas can also be generated from an outside source such as a ship. The BOG is generally at low pressure. Several means are available for disposing of the low pressure BOG. It can be vented to atmosphere or flared, although both of these methods are environmentally unfriendly. In addition, these methods waste a valuable commodity.

Preferably, the BOG is routed to the distribution system or pipeline. High pressure, high horsepower compressors would be required to compress the BOG to pipeline pressure, which can be as high as 100 bar. Condensing the BOG into a liquid send-out stream is more efficient.

Several existing LNG import terminals use systems in which the cold LNG send-out is used to condense BOG at an inter-stage pressure. The BOG condensate can then be combined with the liquid send-out flow before it reaches the booster pumps. Granger's U.S. Pat. No. 6,745,576, for example, discloses a system for re-condensing BOG using a mixing device and a separating device. Engdahl's U.S. Pat. No. 6,470,706 discloses a packed-bed condensing system for re-incorporating BOG into a liquid send-out stream. In the arrangement disclosed in FIG. 1 of that patent, all the liquid send-out from the storage tank passes through the BOG condenser, part as condensing fluid and part as pump fluid. The condensing fluid is used to condense compressed BOG, and the condensate is mixed with the pump fluid before being sent to the booster pumps. In other prior art systems, such as the Dabhol Power Company LNG terminal in Dabhol, India, only a portion of the liquid send-out is routed to the condenser. The condensate is returned to the liquid send-out line through a condensate line.

In the arrangement disclosed in the '706 patent, the flow of condensing fluid is varied to try to maintain a relatively constant pressure in the condenser. If pressure increases, the flow of condensing fluid is increased. If increasing the flow of condensing liquid is not sufficient to keep the pressure in the condenser within the desired range, BOG is vented to a flare. If pressure in the condenser decreases, the flow of condensing fluid is decreased. If decreasing the flow of condensing fluid is not sufficient to keep the pressure within the desired range, make-up gas is introduced into the condenser.

The Dabhol facility similarly provides for venting BOG or adding make-up gas if the pressure in the condenser departs from a desired range. The liquid level in the condenser is generally controlled by adjusting the position of two level control valves on a segment of the liquid send-out line that bypasses the condenser and operates in conjunction with an additional valve and flow meter on the condensing liquid line.

In existing systems, pressure fluctuations in the condenser vessel can significantly affect the operation of the booster pumps and general operation of the pump-out and vaporization system. Also, if the BOG condensing system is not operational, the critical pump-out and vaporization system is not operational.

It is believed that an even better arrangement is possible.

BRIEF SUMMARY

The applicant has developed a new arrangement for a boil-off gas condensing assembly that can be used with a storage tank. Like some previously-known arrangements, the assembly includes a boil-off gas line that is arranged to carry boil-off gas from the storage tank to a boil-off gas condenser, a condensing liquid line that draws condensing liquid for the condenser from the liquid send-out line, and a condensate line in which condensate is returned to the liquid send-out line for transport to the booster pumps.

Unlike prior designs, the disclosed arrangement has a level control valve on the condensing liquid line that actively controls flow through that line based on the liquid level in the condenser. The valve can be controlled, for example, by input from a liquid level transmitter on the boil-off gas condenser or from a differential pressure transmitter that measures both the pressure in the vapor space in the condenser and the pressure of the condensate.

Control of the flow of the condensing liquid is based on the liquid level in the condenser, rather than on condenser pressure. It is conceivable that pressure in the condenser could fall below the inter-stage pressure in the liquid send-out line. Such conditions might result in a reversal of flow through the condensate line. A check valve may sometimes be provided on the condensate line to prevent the reversal of flow into the condenser.

Adequate pressure in the condensing liquid line can be provided in several ways. For example, a send-out valve positioned on the liquid send-out line downstream of the condensing liquid line can be used to provide adequate pressure in the condensing liquid line. The send-out valve can be adjusted in response to, for example, the pressure at some point in the liquid send-out line, or the pressure differential immediately upstream and downstream of that valve. Alternatively, the condensing liquid line can be connected to the liquid send-out line downstream of the booster pumps.

BRIEF DESCRIPTION OF THE DRAWINGS

The invention may be better understood by referring to the accompanying drawings, in which.

DETAILED DESCRIPTION

Figure 1:
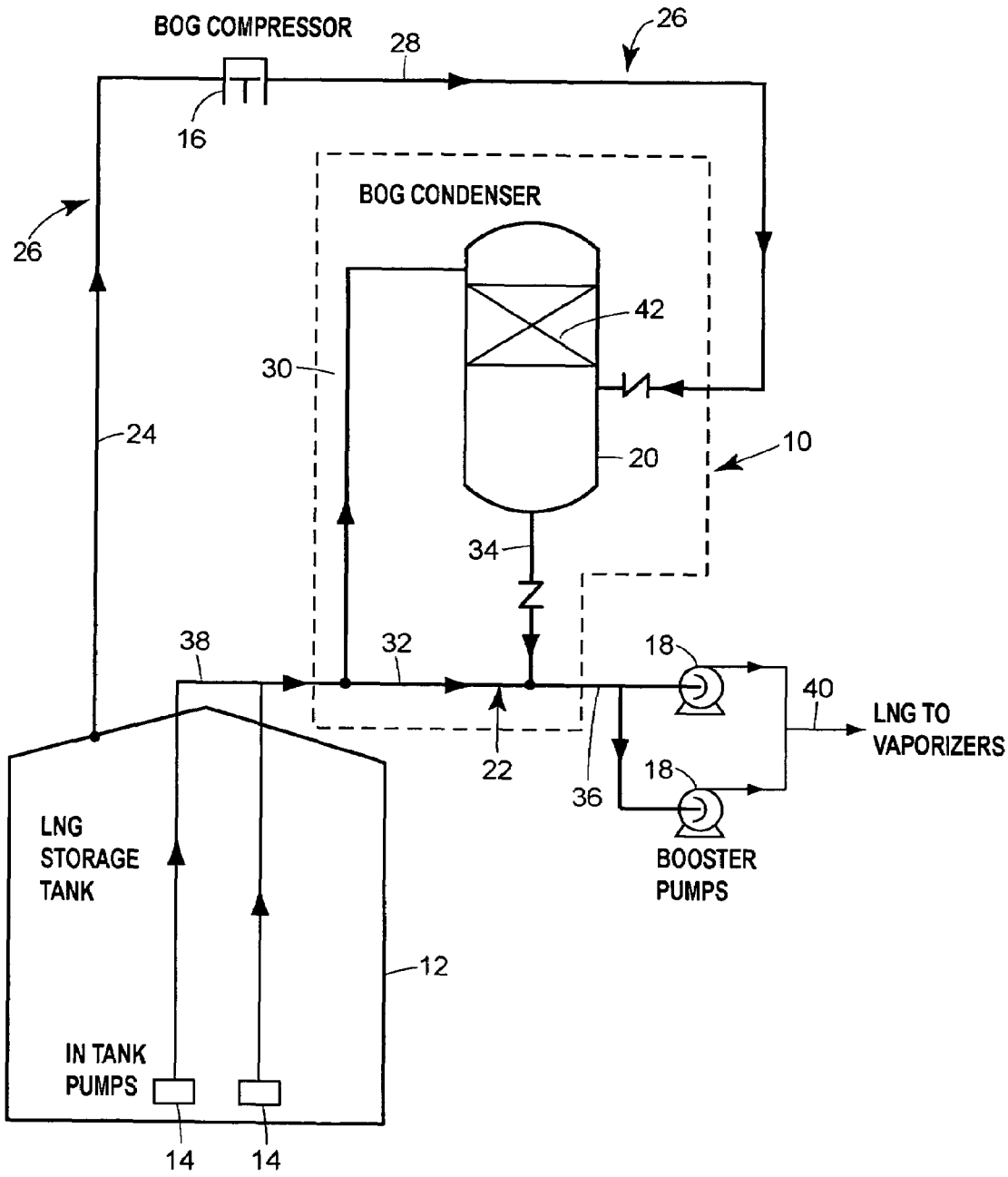
FIG. 1 is a general schematic diagram of an LNG terminal in which an embodiment of the gas-condensing assembly is used.

The condensing assembly 10 illustrated in FIG. 1 is connected to various components of an LNG import terminal.

The LNG terminal includes an LNG storage tank 12 that has one or more internal or external low-stage pumps 14, a BOG compressor 16, high-pressure booster pumps 18, and a BOG condenser 20. An inter-stage liquid send-out line 22 connects the low-stage pumps 14 to the booster pumps 18. Between the pumps, the liquid send-out line 22 operates essentially at the discharge pressure of low-stage pumps 14.

As is known, BOG from the storage tank 12 is typically at a low pressure, and can be boosted to an inter-stage pressure by the BOG compressor 16. A low-stage BOG line segment 24 of a BOG line 26 delivers BOG from the LNG storage tank 12 to the BOG compressor 16. An inter-stage BOG line segment 28 then delivers compressed BOG from the compressor to the condenser 20.

As with prior systems, liquid send-out from the storage tank 12 is used to condense the compressed BOG. The liquid send-out line 22 from the storage tank 12 can be conceptually divided into segments. An initial send-out line segment 38 leads from the storage tank to a branch for a condensing liquid line 30 that supplies condensing liquid to the condenser 20. An intermediate send-out line segment 32 extends from the branch for the condensing liquid line to an inlet from a condensate line 34 that runs from the condenser. A subsequent send-out line segment 36 leads from the inlet from the condensate line to the booster pumps 18. A high-stage send-out line segment 40 carries high-pressure liquid from the booster pumps to the LNG vaporizers for send-out.

Condenser Operation

The illustrated BOG condenser 20 includes a packed bed 42 of random packing elements in the upper portion of the condenser 20, which provides an enhanced surface area for heat and mass transfer for vapor condensing. The heat-and-mass-transfer area can be provided by various surface area arrangements, including structured packing, tray columns, spray elements, or a combination of these arrangements. The shape of the condenser can also vary.

BOG from the BOG compressor 16 enters the illustrated condenser 20 via the BOG line 26 at a location below the packed bed 42. Alternatively, the BOG could enter the condenser 20 at a location above the packed bed or at other locations. The BOG stream entering the condenser 20 would normally be in the gaseous state. However, the entering stream could also be a two-phase stream including both gas and liquid. A desuperheater in the inter-stage BOG line segment 28 may introduce liquid into the stream. Other arrangements may also be used to provide a two-phase stream of BOG to the condenser.

Condensing liquid enters an upper portion of the illustrated condenser 20 through the condensing liquid line 30. The condensing liquid line can also be arranged in other ways.

As the BOG in the condenser 20 comes into contact with the colder condensing liquid, it gives up heat and condenses. The condensing liquid, in turn, warms. The BOG condensate combines with the warmed condensing liquid and both flow downward in the condenser 20. The illustrated condensate line 34, shown at the bottom of the condenser, returns the condensate and condensing liquid to the liquid send-out line 22. Maintaining a hold-up volume of condensate and condensing fluid in the bottom of the condenser may be useful to provide residence time in the event of process upsets.

The pump-out and vaporization system can operate without the BOG condensing assembly being operational. If the BOG system is down for maintenance or other reasons, the facility pump-out and vaporization system can continue to operate by using the intermediate send-out line segment 32 to carry the liquid send-out from the tank, bypassing the boil-off gas condenser.

Liquid Level Control

Figure 2:
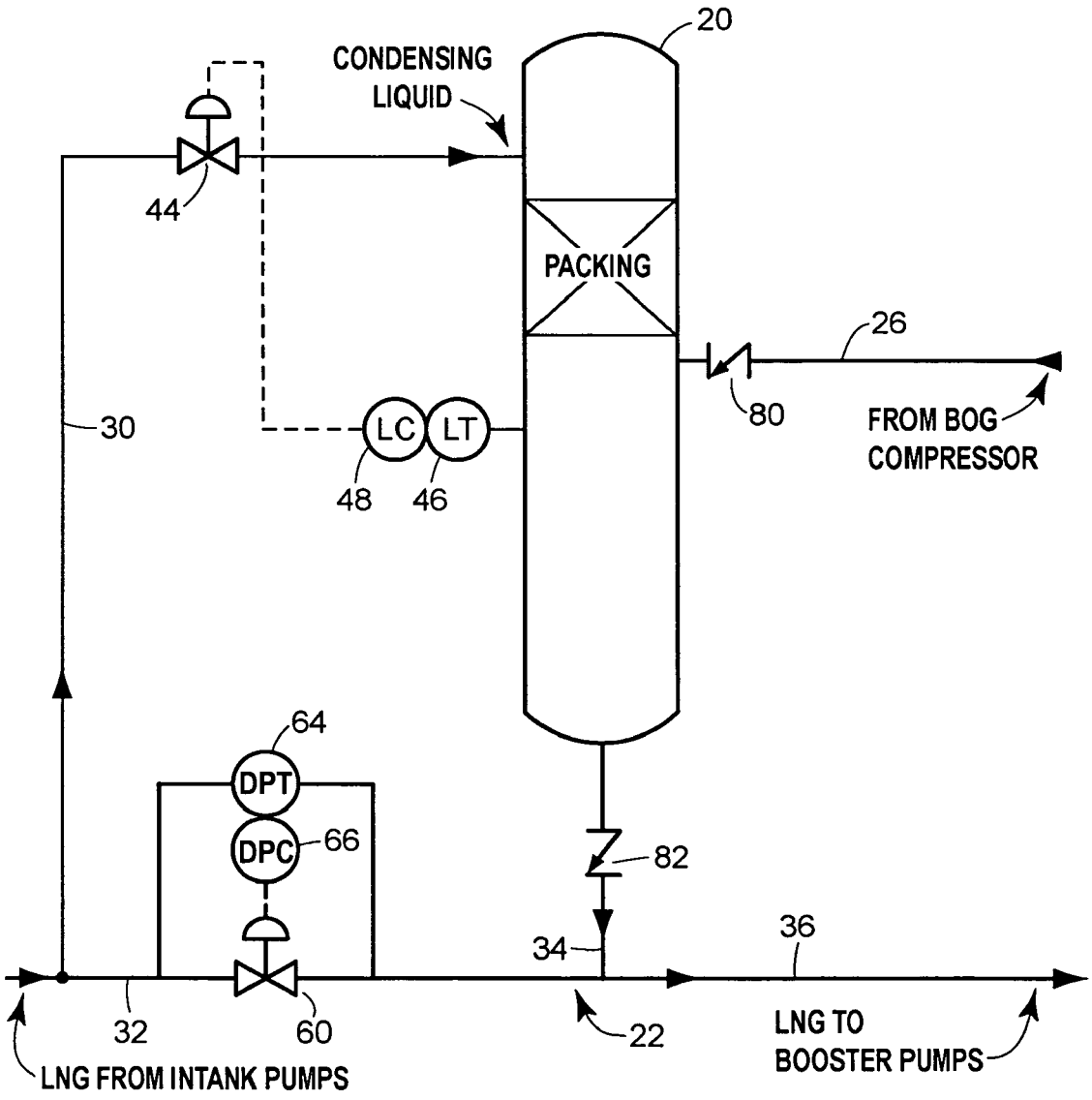
FIGS. 2-5 are detailed schematic diagrams of four alternative embodiments of boil-off gas condensing assemblies that can be used in the terminal seen in FIG. 1.
Figure 3:
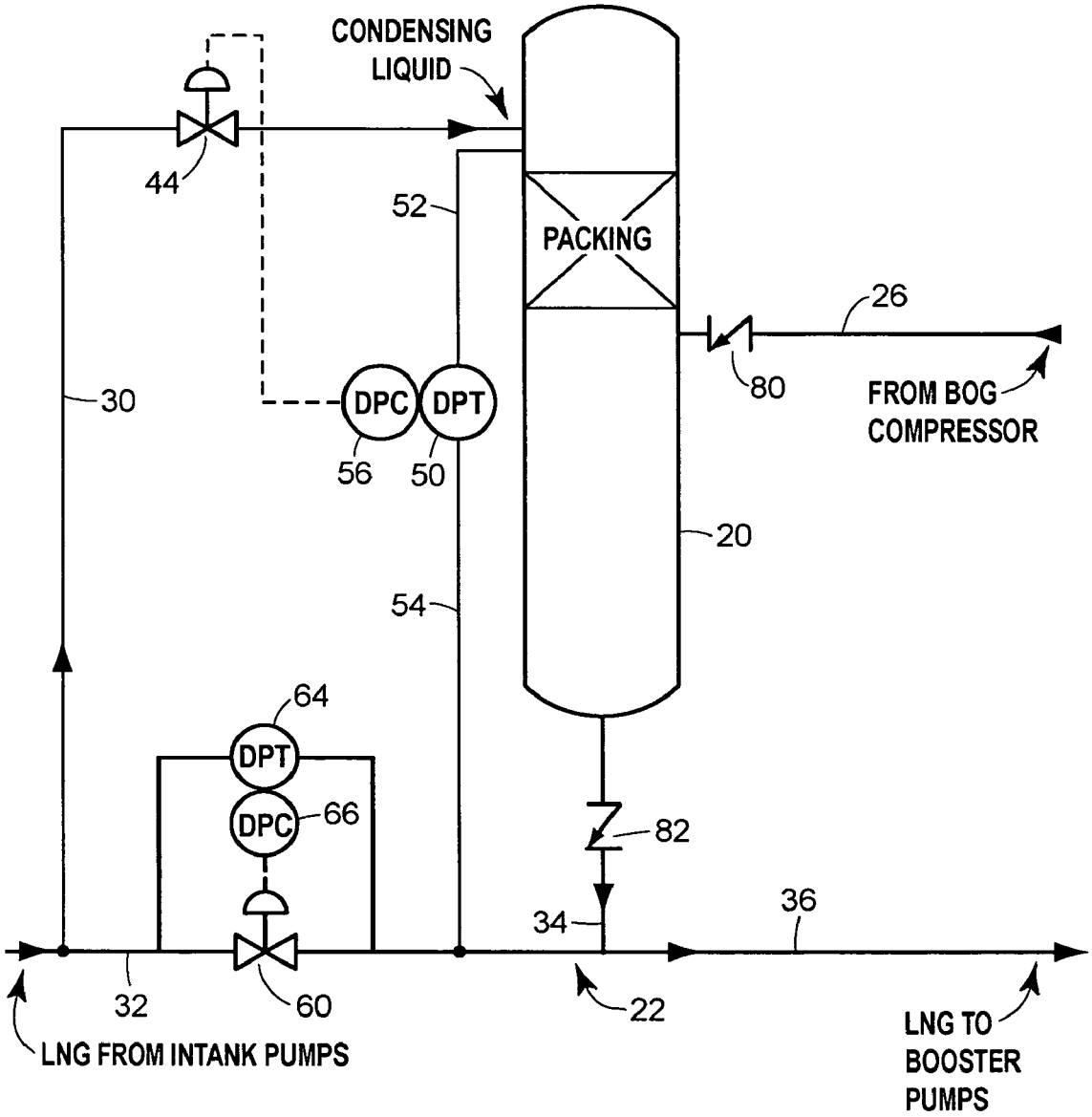
Figure 4:
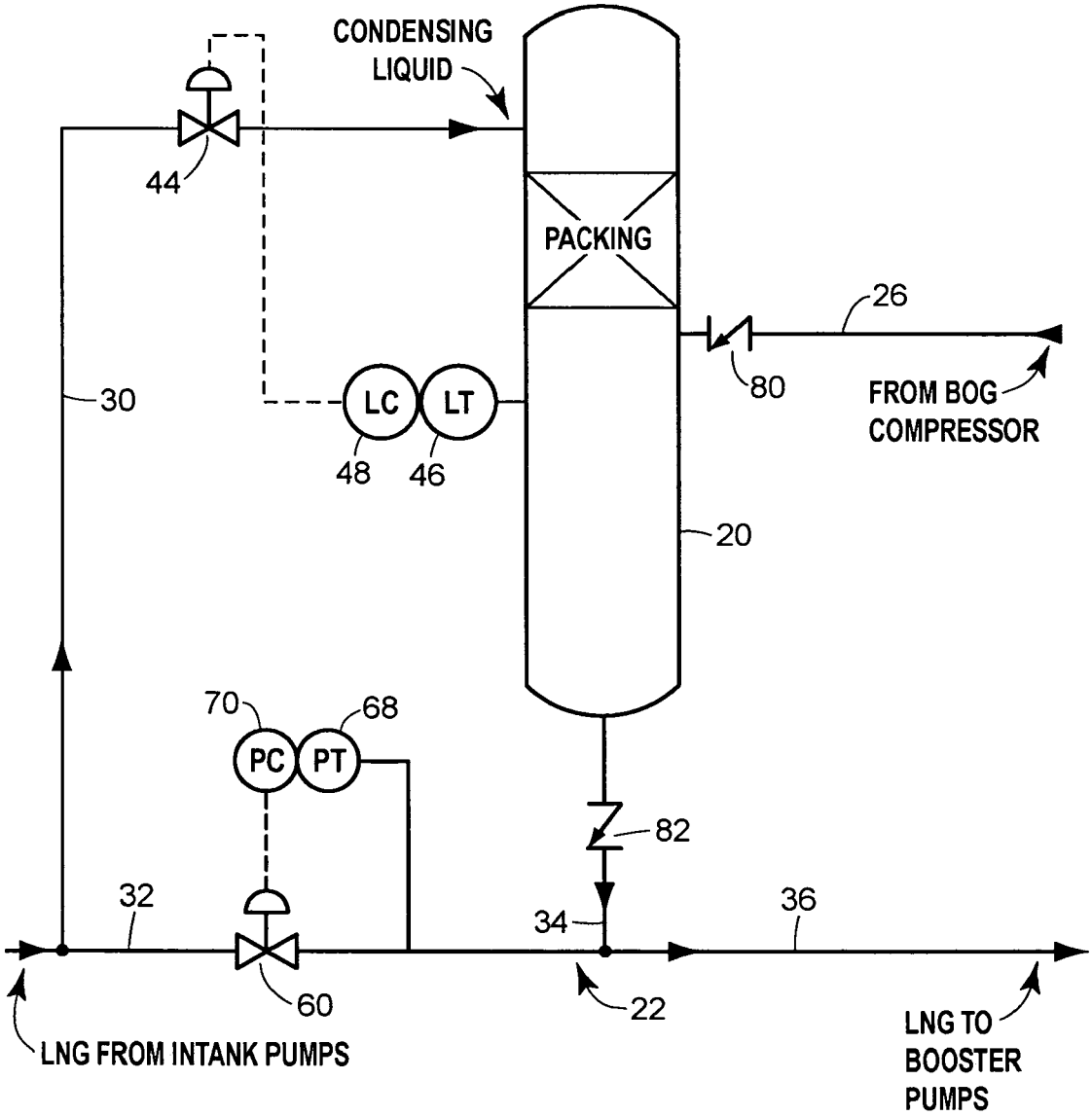

While the general condensing process described above may not be new, the arrangements disclosed in FIGS. 2-4 for controlling the condensing process are new. The illustrated arrangements are designed to condense the maximum quantity of BOG.

Unlike prior known devices, the illustrated arrangements control the condensing process by controlling the flow of condensing liquid based on the liquid level in the condenser 20. To do this, a level control valve 44 is provided on the condensing liquid line 30. When the liquid level in the condenser begins to fall, the valve opens to increase the flow of condensing liquid. When the liquid level in the condenser begins to rise, the valve closes to decrease the flow of condensing liquid.

The changes in the liquid level in the condenser 20 can be detected and signaled in various ways. In the example seen in FIG. 2, a vessel liquid level transmitter 46 detects the liquid level in the condenser and a level controller 48 provides the control logic for the level control valve 44 based on the liquid level input from the liquid level transmitter 46. In the example seen in FIG. 3, a differential pressure transmitter 50 measures the liquid level in the condenser 20 by comparing the gas pressure in the vapor space of the condenser with the liquid pressure in the liquid send-out line 22 (the low-pressure leg 52 of the differential pressure transmitter is connected to the vapor space of the condenser 20 and the high-pressure leg 54 of the transmitter is connected, in this case, to the liquid send-out line 22). A differential pressure controller 56 provides the logic for the level control valve 44 based on the input from the differential pressure transmitter.

The illustrated BOG assembly will continue to condense changing amounts of BOG flow as long as the condensing liquid flow is sufficient. However, if the condensing liquid flow becomes limiting, the liquid level in the condenser 20 may fall. A vessel low liquid level condition that cannot be addressed by a further increase in condensing liquid flow may require a reduction in the BOG flow or an increase in the vessel operating pressure. However, the illustrated condenser is "ventless," i.e., it does not utilize an actively controlled vent for normal operational purposes. Further, a vapor make-up system is not required; it is not necessary to add gas or vent gas from the condenser 20 to maintain pressure in the condenser. The pressure in the condenser is maintained by back pressure in the inter-stage send-out line 22.

Pressure for the Condensing Liquid Line

When the flow of condensing liquid to the condenser 20 is controlled based on the liquid level in the condenser, sufficient pressure is needed in the condensing liquid line 30 to assure adequate flow. Generally, the pressure in the line 30 needs to be slightly higher than the pressure in the condenser 20. That pressure can be provided in different ways.

In the embodiments seen in FIGS. 2-4, a send-out valve 60 is installed on the intermediate send-out line segment 32 of the liquid send-out line. This send-out valve controls the pressure in the portion of the liquid send-out line 22 downstream of the send-out valve 60. Closing the send-out valve increases the pressure upstream of that valve, increasing the pressure in the condensing liquid line 30. As a result, the pressure in the liquid send-out line 22 downstream of the valve 60 and the pressure in the condenser 20 will decrease. Sufficient pressure is available for condensing liquid in the condensing liquid line 30 to enter the condenser 20.

The illustrated send-out valve 60 can be controlled in several ways. FIGS. 2 and 3 illustrate an example of a differential pressure control system on the liquid send-out line 22. In this example, a differential pressure transmitter 64 measures the pressure differential upstream and downstream of the send-out valve. A differential pressure controller 66 opens or closes the valve as necessary to assure a desired pressure differential. FIG. 4 illustrates an alternative arrangement, in which a pressure transmitter 68 measures the pressure downstream of the send-out valve, and a pressure controller 70 adjusts the send-out valve 60 based on input from the pressure transmitter and control logic from the controller.

Figure 5:
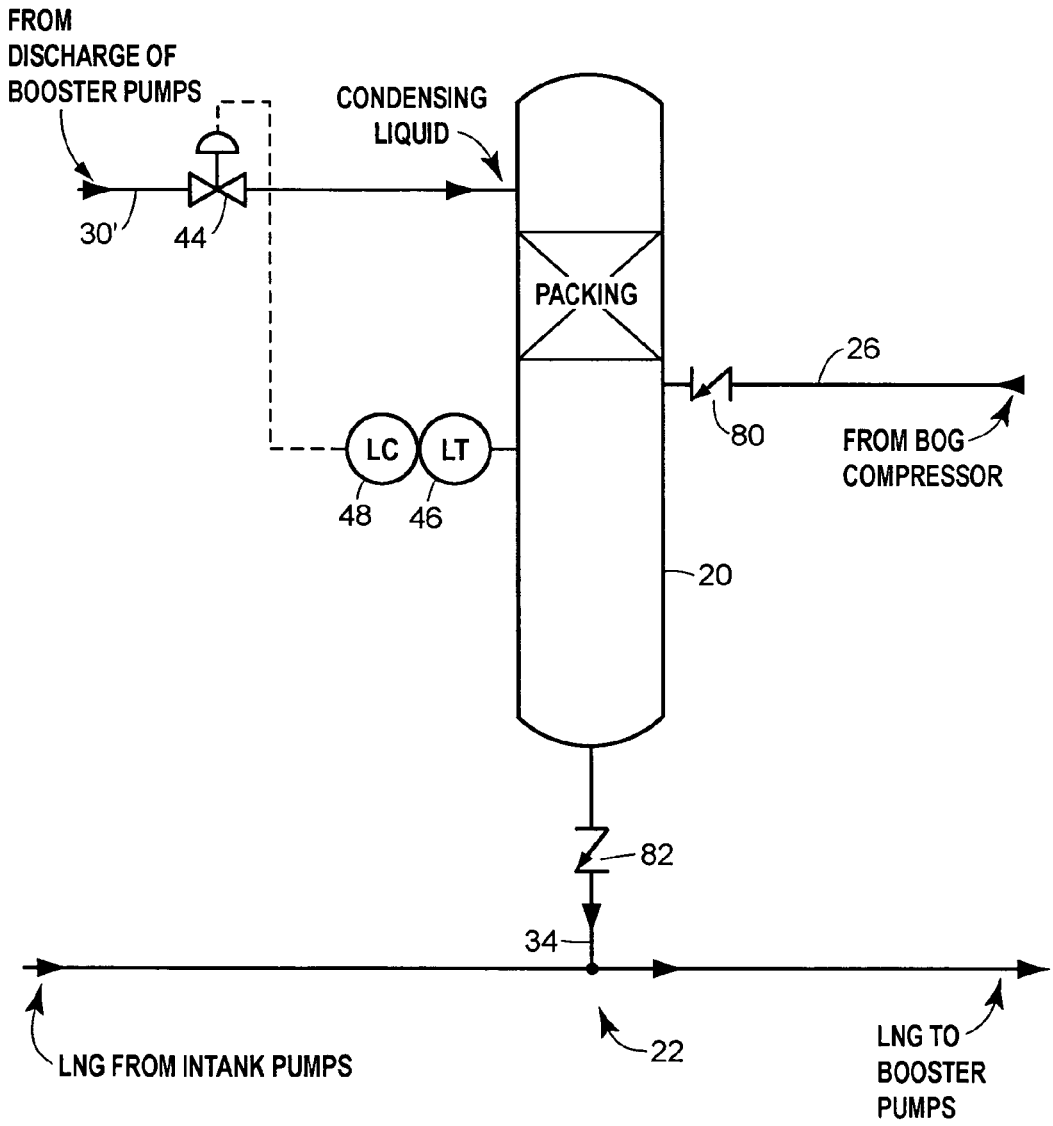

FIG. 5 illustrates another alternative arrangement for assuring adequate pressure in the condensing liquid line 30. In this example, the condensing liquid is obtained from the send-out line 22 downstream of the booster pumps 18. The condensing liquid line 30' runs from the high-stage send-out line segment 40 of the liquid send-out line (see FIG. 1) to the BOG condenser 20. Alternatively, a separate booster pump could be included on the condensing liquid line.

Pressure Control and Check Valves

The vapor space pressure of the condenser 20 is related to the backpressure of the liquid stream being discharged from the condenser. The backpressure is established by the pressure at the junction between the condensate line 34 and the liquid send-out line 22 and the pressure drop from the liquid surface through the condensate line 34. In the arrangements illustrated in FIGS. 2-4, the pressure at the junction can be essentially controlled by the send-out valve 60. Additional controls are provided on the liquid send-out line in conjunction with pump operation. The condenser 20 operating pressure does not determine the liquid send-out line pressure.

The illustrated BOG line 26 includes a check valve 80 that prevents flow reversal in the BOG line 26. The illustrated condensate line 34 includes a check valve 82. The check valve 82 in the condensate line 34 prevents liquid from the liquid line send-out line 22 from entering the vessel and increases the isolation of the condenser operation from the pump-out and vaporization system operation. As a result, condenser operation and upsets will have reduced influence on the operation of the pump-out and vaporization system operation. System stability and reliability are increased.

Nitrogen Addition

The illustrated BOG condenser assembly 10 can be used to add nitrogen to the send-out stream. This can provide a means of adjusting the heating value of the send-out stream. In the illustrated BOG condenser assembly, low pressure vapor phase nitrogen can be added to the send-out stream via condenser 20. A higher nitrogen content may lower the condensing temperature. Therefore, the operating pressure of the BOG condenser may need to be increased to provide the desired condensation.

Alternatively, liquid phase nitrogen can be injected. Liquid nitrogen could be combined with the stream of condensing liquid in the condensing liquid line 30, but could also be injected into an inter-stage segment of the liquid send-out line 22, such as the intermediate send-out line segment 32 or the subsequent send-out line segment 36. If added, liquid nitrogen should be warmer than the temperature at which components of the LNG might freeze.

Alarms

Subcooled liquid increases the available net positive suction head for the booster pumps 18, increasing the reliability of the pumps. A control and alarm system designed to assure a subcooled liquid stream to the booster pumps may be a feature of this BOG condensing assembly.

Thermocouples may be installed on the condenser 20 and in the liquid send-out line 22 down stream of the condenser 20. Controls would be provided to determine the temperature difference between the two thermocouples. During normal operation, the temperature of the liquid send-out line 22 will be colder than the temperature of the liquid surface in the condenser 20. The differential temperature between the two thermocouples can give an indication of the degree of subcooling of the LNG liquid entering the booster pumps, which in turn can be incorporated into a control and alarm system.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A boil-off gas condensing assembly for use with a storage tank that has a liquid send-out line, the assembly comprising:

a boil-off gas condenser in which boil-off gas is in direct contact with condensing liquid;

a boil-off gas line arranged to carry storage tank boil-off gas to the boil-off gas condenser;

a condensing liquid line that connects a first segment of the liquid send-out line to the boil-off gas condenser;

a condensate line from the boil-off gas condenser to the liquid send-out line; and a level control valve that actively controls flow through the condensing liquid line based on the liquid level in the boil-off gas condenser;

wherein the condenser operating pressure does not determine the liquid send-out line pressure.

2. A boil-off gas condensing assembly for use with a storage tank that has a liquid send-out line, the assembly comprising:

a boil-off gas condenser:

a boil-off gas line arranged to carry storage tank boil-off gas to the boil-off gas condenser;

a condensing liquid line that connects a first segment of the liquid send-out line to the boil-off gas condenser;

a condensate line from the boil-off gas condenser to the liquid send-out line; and a level control valve that is mounted on the condensing liquid line and actively controls flow through the condensing liquid line based on the liquid level in the boil-off gas condenser.

3. A boil-off gas condensing assembly as recited in claim 1, in which the liquid send-out line pressure determines the pressure of the boil-off gas condenser.

4. A boil-off gas condensing assembly as recited in claim 1, in which the level control valve is controlled by input from a liquid level transmitter on the boil-off gas condenser.

5. A boil-off gas condensing assembly as recited in claim 1, in which the level control valve is controlled by input from a differential pressure transmitter that determines the liquid level in the boil-off gas condenser.

6. A boil-off gas condensing assembly as recited in claim 1, in which the boil-off gas line includes a boil-off gas compressor.

7. A boil-off gas condensing assembly as recited in claim 1, in which the condensing liquid line is connected to the liquid send-out line upstream of the condensate line connection to the send-out line.

8. A boil-off gas condensing assembly as recited in claim 1, in which the condensing liquid line is connected to the liquid send-out line upstream of a booster pump.

9. A boil-off gas condensing assembly for use with a storage tank that has a liquid send-out line, the assembly comprising:

a boil-off gas condenser:

a boil-off gas line arranged to carry storage tank boil-off gas to the boil-off gas condenser:

a condensing liquid line that connects a first segment of the liquid send-out line to the boil-off gas condenser;

a condensate line from the boil-off gas condenser to the liquid send-out line;

an intermediate segment of the liquid send-out line that bypasses the condenser, extending between (a) the junction between the first segment of the liquid send-out line and the condensing liquid line and (b) the junction between the condensate line and the liquid send-out line;

a send-out valve that is positioned on the intermediate segment of the liquid send-out line; and a level control valve that actively controls flow through the condensing liquid line based on the liquid level in the boil-off gas condenser.

10. A boil-off gas condensing assembly as recited in claim 9, in which the send-out valve is controlled based upon pressure differential upstream and downstream of that valve.

11. A boil-off gas condensing assembly as recited in claim 9, in which the send-out valve is controlled based on pressure downstream of that valve.

12. A boil-off gas condensing assembly as recited in claim 1, in which the condensate line includes a check valve.

13. A boil-off gas condensing assembly as recited in claim 1, in which the boil-off gas condenser is ventless under design operating conditions.

14. A boil-off gas condensing assembly as recited in claim 1, in which the condenser does not include a make-up gas system.

15. A boil-off gas condensing assembly as recited in claim 1, in which the condenser does not include an active pressure control system.

16. A boil-off gas condensing assembly as recited in claim 1, in which the condensing liquid line is connected to the liquid send-out line downstream of a low-stage pump connected to the liquid send-out line.

17. A boil-off gas condensing assembly as recited in claim 1, in which the condensate line is connected to the liquid send-out line upstream of a booster pump on the liquid send-out line.

18. A boil-off gas condensing assembly as recited in claim 1, in which the condensing liquid line is connected to the liquid send-out line downstream of a low-stage pump connected to the liquid send-out line and the condensate line is connected to the boil-off gas send-out line upstream of a booster pump on the liquid send-out line.

19. A boil-off gas condensing assembly as recited in claim 1, and further comprising a nitrogen injection line on the liquid send-out line.

20. A boil-off gas condensing assembly as recited in claim 1, in which an intermediate send-out line segment enables liquid send-out to be delivered to downstage booster pumps even when the boil-off gas condenser is not operational.

21. A method for condensing boil-off gas from a storage tank, using the steps of:

providing a boil-off gas condenser vessel that has a boil-off gas inlet, a condensing liquid inlet, and a condensate inlet that connects to a send-out line that has an operating pressure;

directing boil-off gas into the boil-off gas condenser vessel via the boil-off gas inlet;

directing condensing liquid into the boil-off gas condenser vessel via the condensing liquid inlet;

condensing the boil-off gas flow with the condensing liquid flow;

maintaining the boil-off gas condenser vessel liquid level with the condensing liquid flow, wherein the boil-off gas condenser vessel operating pressure is determined by the send-out line operating pressure.

* * * * *

UNITED STATES PATENT AND TRADEMARK OFFICE

CERTIFICATE OF CORRECTION

PATENT NO. : 7,493,778 B2
APPLICATION NO. : 11/502947
DATED : February 24, 2009
INVENTOR(S) : Gerald E. Engdahl It is certified that error appears in the above-identified patent and that said Letters Patent is hereby corrected as shown below:

At Column 6, line 67, “condenser:” should be -- condenser; --.

Signed and Sealed this

Twenty-first Day of July, 2009

JOHN DOLL
*Acting Director of the United States Patent and Trademark Office*